United States Patent [19]

Andis

[11] 4,456,815

[45] Jun. 26, 1984

[54] REMOVABLE HAIR GROOMING ATTACHMENT FOR A CURLING IRON

[75] Inventor: Matthew L. Andis, Racine, Wis.

[73] Assignee: Andis Company, Racine, Wis.

[21] Appl. No.: 372,986

[22] Filed: Apr. 29, 1982

Related U.S. Application Data

[62] Division of Ser. No. 59,676, Jul. 23, 1979, abandoned.

[51] Int. Cl.[3] ..... A45D 1/04; A45D 1/18; H05B 3/40

[52] U.S. Cl. ..... 219/225; 132/9; 132/11 R; 132/33 R; 132/37 R; 132/118; 219/230

[58] Field of Search ..... 219/222–226, 219/230, 533; 15/27; 132/9, 11 R, 33 R, 33 F, 33 G, 34 R, 37 R, 37 A, 39–41, 117, 118, 85

[56] References Cited

U.S. PATENT DOCUMENTS

| | | | |
|---|---|---|---|
| 411,028 | 9/1889 | Heysinger | 219/222 |
| 3,135,269 | 6/1964 | Pauldine | 132/33 R |
| 3,909,868 | 10/1975 | Nogues | 219/222 UX |
| 4,024,375 | 5/1977 | Olesen et al. | 219/225 |
| 4,029,110 | 6/1977 | Hyland | 219/222 X |
| 4,197,608 | 4/1980 | Holley et al. | 219/222 UX |
| 4,267,851 | 5/1981 | Plaisted | 219/222 X |
| 4,292,986 | 10/1981 | Ergaver et al. | 219/222 X |
| 4,314,137 | 2/1982 | Dorn | 219/222 |
| 4,329,567 | 5/1982 | Kunz et al. | 219/222 |

FOREIGN PATENT DOCUMENTS

| | | | |
|---|---|---|---|
| 867075 | 1/1978 | Belgium | 219/222 |
| 2501682 | 7/1976 | Fed. Rep. of Germany | 132/9 |
| 2022406 | 12/1979 | United Kingdom | 219/222 |

*Primary Examiner*—A. Bartis

*Attorney, Agent, or Firm*—Michael, Best & Friedrich

[57] ABSTRACT

A curling iron includes a handle, a cylindrical electric heating element having an outer peripheral surface and a first end attached to the handle and a second end projecting outwardly from the handle. A plurality of generally arcuately spaced longitudinally extending grooves are defined on the outer peripheral surface of the heating element between the first and the second ends. A removable hair grooming attachment including an annular frame having a plurality of arcuately spaced support bars slidable engaged in the grooves is carried by the heating element. The annular frame has a first frame end having an inner diameter at least equal to the inner diameter of the main body portion to accommodate the sliding engagement of support bars in the grooves through the first frame end as well as a second frame end oppositely spaced from the first end and having an inner diameter less than the inner diameter of the annular frame to abut against the second end of the heating element to limit sliding engagement of the support bars in the grooves beyond the second frame end. A fastener secures the annular frame to the heating element. The hair grooming attachment includes a manually operable hair clamping member pivotally attached to the frame and cooperable with the heating element for making tight curls.

3 Claims, 8 Drawing Figures

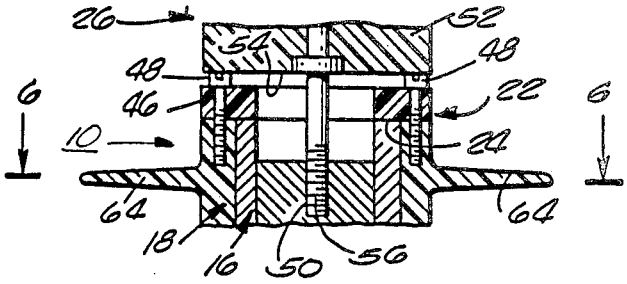
Fig. 5
Fig. 6
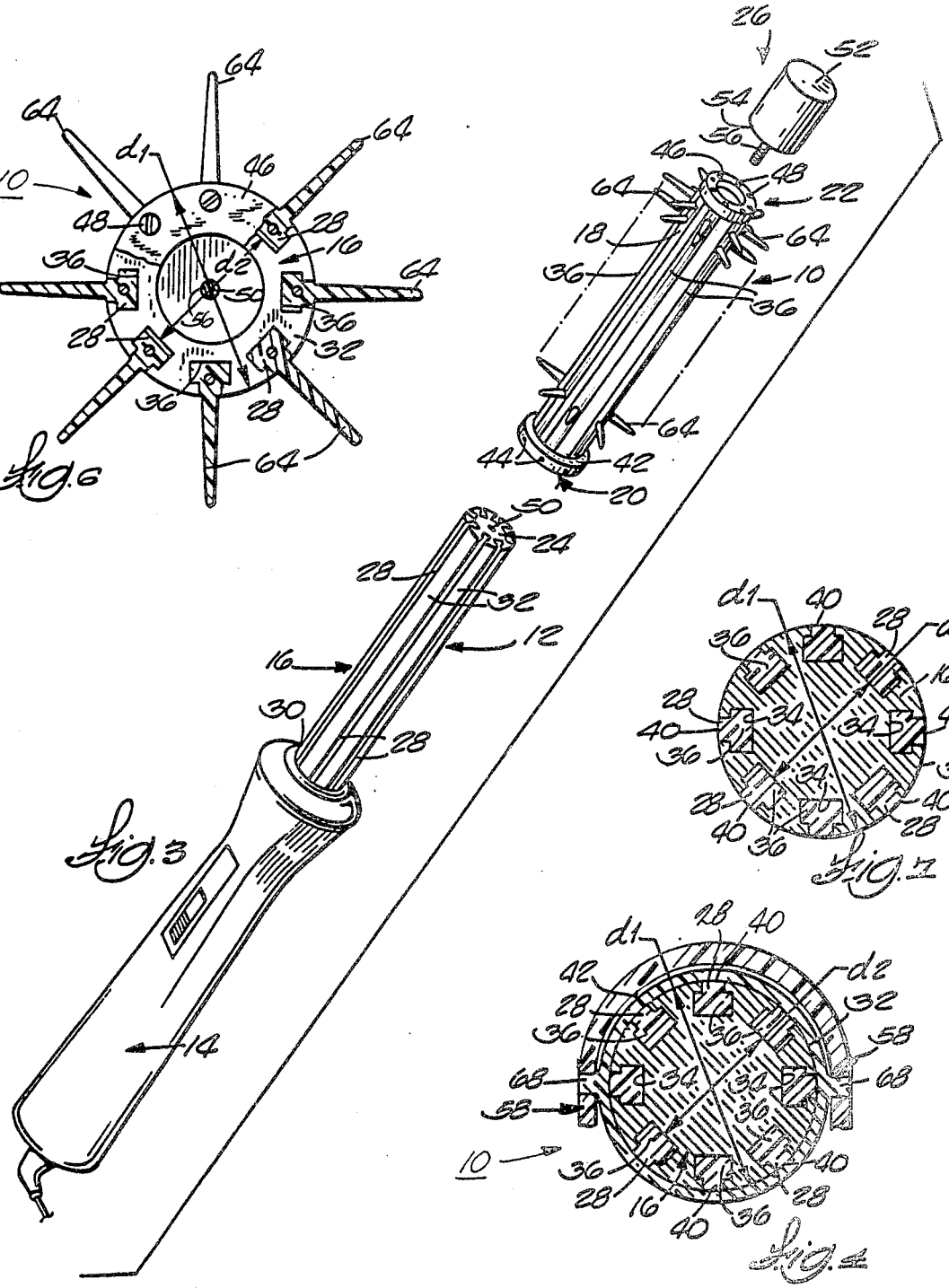
Fig. 3
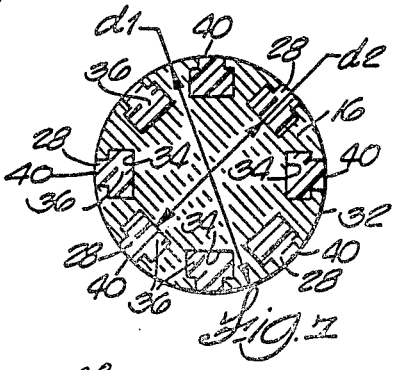
Fig. 7
Fig. 4

REMOVABLE HAIR GROOMING ATTACHMENT FOR A CURLING IRON

This application is the division of application Ser. No. 059,676, filed July 23, 1979 now abandoned.

FIELD OF THE INVENTION

The invention generally relates to hair grooming devices. More particularly, the invention relates to curling irons and hair grooming devices usable in combination with curling irons.

DESCRIPTION OF THE PRIOR ART

Curling irons are widely used to curl or otherwise style hair. To facilitate the use of curling irons in creating particular hair styles, curling irons typically include integral hair grooming assemblies such as hair clamping members which are used in forming small or "tight" curls or brushes which are used in forming large or "loose" curls and waves.

SUMMARY OF THE INVENTION

The invention provides a hair grooming attachment for a curling iron having a handle and a heating element which extends from the handle. The attachment generally comprises a main body portion having an inner diameter which permits sliding attachment of the main body portion upon the heating element. The main body portion includes a first end having an inner diameter at least equal to the inner diameter of the main body portion to thereby accommodate the sliding attachment of the main body portion upon the heating element through the first end. The main body portion also includes an oppositely spaced second end which has an inner diameter less than the inner diameter of the main body portion to prevent sliding attachment of the main body portion on the heating element beyond the second end.

In one embodiment of the invention, the hair grooming attachment includes fastening means engagable with the heating element and the second end of the main body portion for securing the second end of the main body portion between the fastening means and the heating element. The entire grooming attachment can be thereby removably secured to the heating element during use.

In one embodiment of the invention, the curling iron includes means which defines a plurality of generally arcuately spaced grooves extending longitudinally on the outer peripheral surface of the heating element. The outer peripheral surface of the heating element has a first diameter, and the grooves have inner peripheral surfaces concentric with the outer peripheral surface and having a second diameter less than the first diameter. In this embodiment, the hair grooming attachment comprises an annular frame including a plurality of arcuately spaced support bars which are slidably engaged in the grooves. More particularly, the arcuately spaced support bars have an outer diameter which is generally equal to the first diameter and an inner diameter which is generally equal to the second diameter.

In one embodiment of the invention, the annular frame includes a first frame end having an inner diameter at least equal to the first diameter to accommodate the sliding engagement of the support bars in the grooves through the first frame end, as well as an oppositely spaced second frame end having an inner diameter less than the first diameter to prevent the sliding engagement of the support members in the grooves beyond the second frame end and to thereby provide an abutting engagement between the second frame end and the outer end of the heating element. In this embodiment, the length of the annular frame is less than the length of the heating element, and the abutment between the second frame end and the outer end of the heating element maintains the first frame end in a spaced relationship from the handle end of the heating element to permit heat expansion of the annular frame during operation of the curling iron.

In one embodiment of the invention, the hair grooming attachment includes a hair clamping member which is pivotally attached on the annular frame and which is slidingly engaged on the heating element in common with the annular frame. The hair clamping member permits use of the curling iron to make small or "tight" curls.

In an alternate embodiment, a plurality of generally spaced bristles project outwardly from the annular frame and collectively form a brush which permits use of the curling iron to make large or "loose" curls. The brush, like the just described hair clamping member, is slidingly engaged on the heating element in common with the annular frame. Thus, the hair grooming attachment having the brush is freely interchangeable with the hair grooming attachment having the hair clamp, and a single curling iron can be used to form both large and small curls.

One of the principal features of the invention is an attachment for the heating element of a curling iron, which attachment allows interchangeable use of different hair grooming assemblies in connection with a single curling iron.

Other features and advantages of the embodiments of the invention will become known by reference to the following general description, claims, and the drawings.

DESCRIPTION OF THE DRAWINGS

FIG. 3 is an exploded view of a curling iron and a hair grooming attachment which is slidably engagable thereon;

FIG. 4 is a sectional view of the grooming attachment taken generally along line 4—4 in FIG. 2;

FIG. 5 is a fragmentary sectional view of the grooming attachment and the related fastening means taken generally along line 5—5 in FIG. 1;

FIG. 6 is a view taken generally along line 6—6 in FIG. 5 with certain parts shown in section and certain parts shown in full lines.

FIG. 7 is a sectional view of the grooming attachment taken generally along line 7—7 in FIG. 2.

Figure 1:
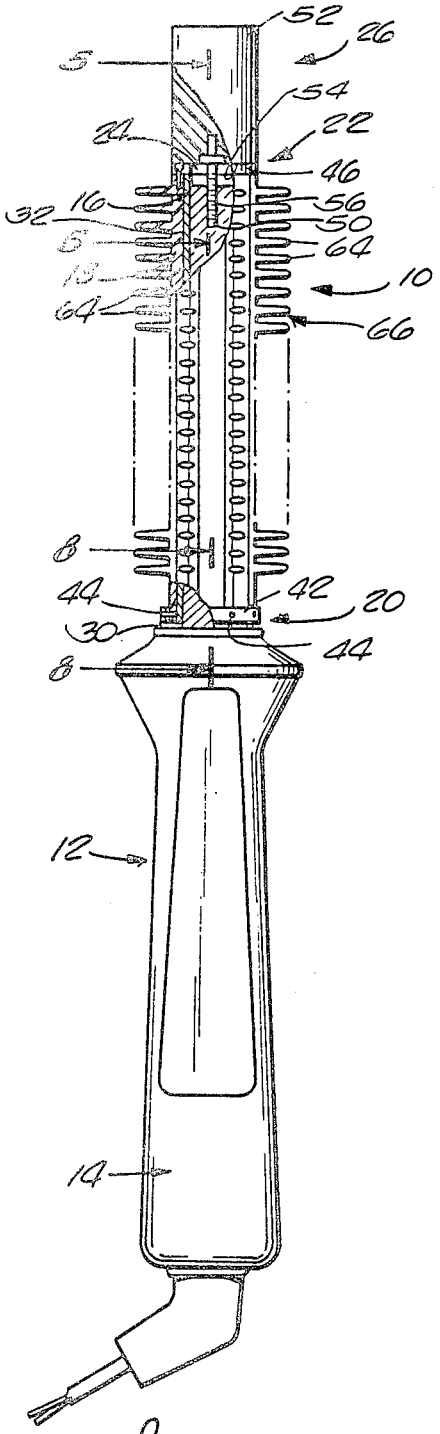
FIG. 1 is a hair grooming attachment having bristles forming a brush and which is slidably engaged upon the heating element of a curling iron.

Before explaining the embodiments of the invention in detail, it is to be understood that the invention is not limited in its application to the details of construction and the arrangement of components set forth in the following description and as illustrated in the drawings. The invention is capable of other embodiments and of being practiced and carried out in various ways. Also, it is to be understood that the phraseology and terminology used herein for the purpose of description should not be regarded as limiting.

GENERAL DESCRIPTION

Shown in the drawings is a hair grooming attachment 10 and its use in connection with a curling iron 12. The curling iron 12 generally includes a handle 14 and a heating element 16 extending from the handle 14 (as is best shown in FIG. 3). The element 16 is electrically operated to radiate heat, and the grooming attachment 10 generally serves to facilitate the use of the radiated heat to curl or otherwise style the operator's hair.

Figure 2:
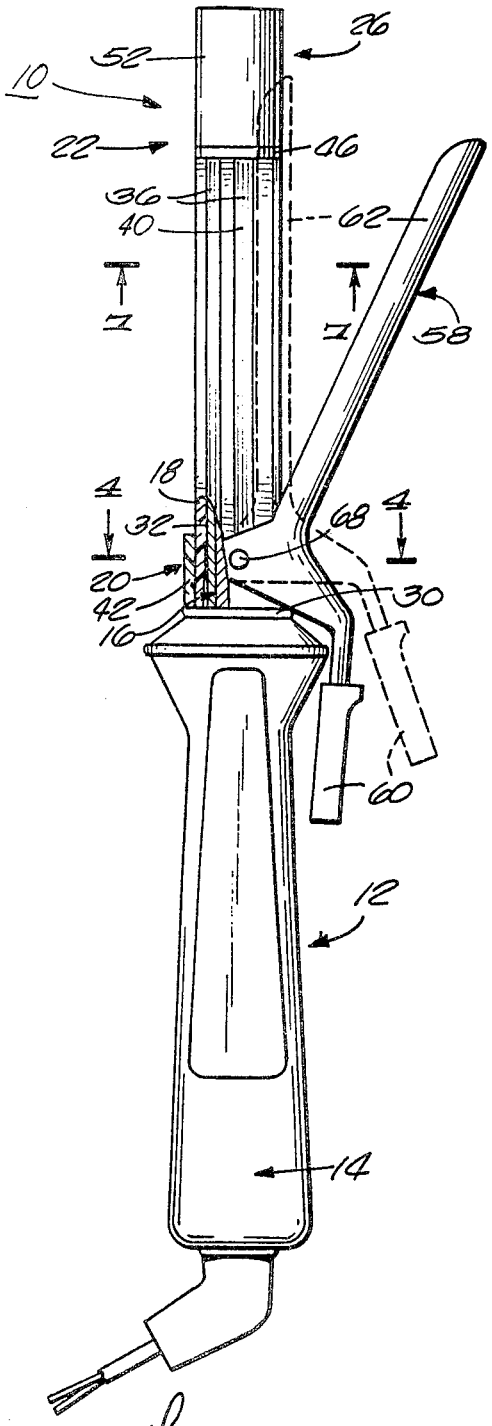
FIG. 2 is a hair grooming attachment having a pivotally attached hair clamping member and which is slidably engaged upon the heating element of a curling iron and interchangeable on the heating element with the brush attachment shown in FIG. 1.
Figure 8:
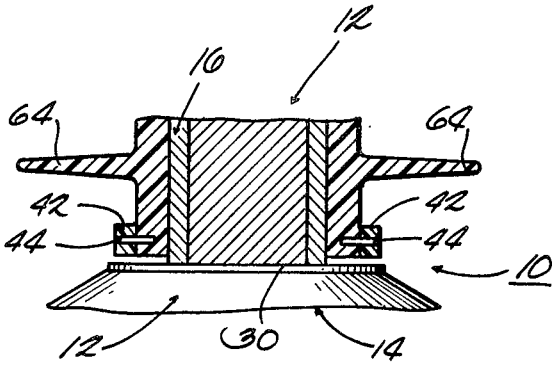
FIG. 8 is a fragmental view taken generally along line 8—8 in FIG. 1 with certain parts shown in section and certain parts shown in full lines.

Referring first principally to FIGS. 1, 2, and 3, the attachment 10 generally includes a main body portion 18 which has an inner diameter sufficient to permit sliding attachment of the main body portion 18 upon the heating element 16. The main body portion 18 includes a first end 20 which has an inner diameter at least equal to the inner diameter of the main body portion 18 and an oppositely spaced second end 22 which has an inner diameter less than the inner diameter of the main body portion 18. By virtue of this construction, the first end 20 accommodates the sliding attachment of the main body portion 18 upon the heating element 16, while the second end 22 does not. Thus, sliding attachment of the main body portion 18 upon the heating element 16 is permitted only through the first end 20 (as shown in FIG. 3), and the sliding attachment thereafter progresses until the second end 22 of the main body portion 18 reaches the outer end 24 of the heating element 16 (as shown in FIGS. 1 and 2). The difference in diameters between the second end 22 and the outer end 24 (see FIGS. 1 and 5) blocks further sliding attachment of the main body portion 18 beyond the second end 22.

As is best shown in FIGS. 1, 2 and 5, fastening means 26 is engagable with the heating element 16 and the second end 22 of the main body portion 18 to secure the second end 22 between the fastening means 26 and the heating element 16 and thereby hold the grooming attachment 10 in place upon the heating element 16.

It should be appreciated that the hair grooming attachment 10 as just generally described is broadly applicable for use in combination with curling irons of various constructions, and the particular construction of the attachment 10 may be varied according to the design of the associated curling iron as well as the particular hair curling or styling function sought to be accomplished.

In the illustrated embodiment (as best shown in FIG. 3), the curling iron 12 includes a plurality of arcuately spaced grooves 28 extending longitudinally along the outer peripheral surface 32 of the heating element 16 between the handle end 30 of the element 16 and the outer end 24 thereof. As can best be seen in FIG. 7, the outer peripheral surface 32 of the heating element 16 has a first diameter d1, and the arcuately spaced grooves 28 have inner peripheral surfaces 34 concentric with the outer peripheral surface 32 of the element 16 and having a second diameter d2 which is less than the first diameter d1. It should be appreciated that the specific shape of the grooves 28 may be varied from that shown in the drawings. For example, the grooves 28 may take the form of a dovetail as well as any square, rectangular, or arcuate indentation formed in the outer peripheral surface 32 of the heating element 16.

In this embodiment, the main body portion 18 of the grooming attachment 10 forms an annular frame or cage (see FIG. 3) which includes a plurality of arcuately spaced support bars 36. While the frame 18 may be constructed of various materials, it is preferably made of heat resistant plastic.

The number of support bars 36 is equal in number and spacing to the grooves 28. The frame 18 has an outer diameter (see FIG. 7) generally equal to the first mentioned diameter d1 of the outer peripheral surface 32 of the heating element 16 and an inner diameter generally equal to the second mentioned diameter d2 of the inner peripheral surfaces 34 of the grooves 28.

By virtue of these generally matched inner and outer diameters of the heating element 16 and support bars 36, and as can be seen in FIGS. 6 and 7, the annular frame 18 slidingly engage the grooves 28. Furthermore, the outer peripheral surface 40 of the support bars 36 is generally flush with the outer peripheral surface 32 of the heating element 16, thereby enhancing the transfer of heat between the element 16 and the hair of a user. The outer peripheral surface 40 of the support bars 36 may be smooth, as is shown in the drawings, or it may be roughened or serrated to facilitate the holding of hair against the annular frame 18.

In this embodiment, the first end 20 of the annular frame 18 takes the form of a first annular member 42, also preferably made of heat resistant plastic, attached to the annular frame 18. Preferably the first annular member 42 is molded directly to the annular frame 18, but the first annular member 42 may also be attached by glue (as is generally shown in FIG. 2) or by a plurality of pins 44 (as shown in FIGS. 1 and 3) which extend through the first annular member 42 into the support bars 36. As is best shown in FIG. 4, the first annular member 42 has an inner diameter at least equal to the first mentioned diameter d1 of the outer peripheral surface 32 of the heating element 16 and forms a collar which commonly encircles the flush outer peripheral surfaces 32 and 40 of the heating element 16 and support bars 36.

The second end 22 of the annular frame 18 takes the form of a second annular member 46, also perferably made of heat resistant plastic, attached to the annular frame 18. Like the first annular member 42, the second annular member 46 is preferably molded directly to the annular frame 18, but it may also be attached by glue or a plurality of screws 48 extending into the support bars 36 (see FIGS. 5 and 6). As is best shown in FIG. 5, the second annular member 46 has an inner diameter which is less than the first mentioned diameter d1 of the outer peripheral surface 32 of the heating element 16 and an outer diameter generally equal to the first mentioned diameter d1 so that the second annular member 46 takes the form of a ring fastened in registry upon the frame 18.

Thus, as heretofore generally described, the first annular member 42 accommodates the sliding engagement of the support bars 36 within the grooves 28, whereas the second annular member 46 does not. The sliding engagement between the support bars 36 and the grooves 28 proceeds through the first annular member 42 until abutting engagement between the second annular member 46 and the outer end 24 of the heating element 16 occurs (as shown in FIGS. 1 and 5).

As shown in FIGS. 1 and 2, the length of the annular frame 18 is less than the length of the heating element 16 so that, when abutment between the second annular member 46 and the outer end 24 of the heating element 16 occurs, the first annular member 42 is located in a spaced relationship from the handle end 30 of the heating element 16. By virtue of this construction, heat expansion of the frame 18 is permitted during operation of the curling iron 12.

In the illustrated embodiment, the heating element 16 has an internally threaded hole 50 centrally formed in its outer end 24. The fastening means 26 takes the form of a plug-shaped member 52 having an outer diameter generally equal to the outer diameter d1 of the heating element 16 and preferably made of a heat resistant material such as plastic or rubber. The plug member 52 includes an underbody portion 54 and an externally threaded pin 56 projecting downwardly from the center of the underbody portion 54. Rotation of the plug member 52 causes the pin 56 to threadably engage the hole 50, and the second annular member 46 is thereby sandwiched between the underbody surface 54 of the plug member 52 and the outer end 24 of the heating element 16. Movement of the annular frame 18 axially along the heating element 16 is thereby prevented. Also, by virtue of the engagement between the grooves 28 and the support bars 36, rotation of the grooming attachment upon the heating element 16 is likewise prevented.

It should be appreciated that the plug member 52 may be alternatively molded directly to the second annular member 46 to provide a heat resistant gripping surface to facilitate attachment and removal of the annular frame 18 upon the heating element 16. In this embodiment, the unitary annular frame 18 and plug member 52 may be held in place upon the heating element 16 by means of friction or by another suitable fastening mechanism, such as a spring-detent assembly (not shown).

As before mentioned, the particular structure of the hair grooming attachment 10 as just described may be varied to accommodate the particular curling or styling function desired. Just as there are numerous hair styles, there are numerous structural variations of the grooming attachment 10 which are possible. Two such variations are shown.

Referring to the first variation which is best shown in FIGS. 2, 4 and 7, the attachment 10 includes a hair clamping member 58 which is pivotally attached on the annular frame 18 for movement between a first position (shown in solid lines in FIG. 2) in which the hair clamping member 58 extends at an angle from the annular frame 18 and a second position (shown in phantom lines in FIG. 1) in which the hair clamping member 58 is located closely adjacent to the annular frame 18. While the pivot point may be variously located, in the illustrated embodiment, the first annular ring 42 includes a pair of outwardly projecting shoulders 68 (as best shown in FIG. 4) upon which the hair clamping member 58 is pivotally attached. The hair clamping member 58, which may be of either plastic or metal unitary construction, includes an outwardly projecting arm 60 extending over the handle 14 of the curling iron 12 so that the operator may easily control the pivotal movement of the clamping member 58 simultaneously with operation of the curling iron 12. Preferably, and as is shown in FIG. 2, the outer tip of the clamping member 58 extends beyond the outer end 24 of the heating element 16 and over the heat resistant plug member 52, so that the operator is able to hold the outer tip of the clamping member 58 against the plug member 52 to maintain the clamping member 52 in its second position. The clamping member 58 also includes a generally concave clamping surface 62 which fits in registry with the flush outer peripheral surfaces 32 and 40 of the heating element 16 and support bars 36 when the clamping member 58 is in its second position. The operator is thus able to hold his or her hair in place between the concave clamping surface 62 and the outer peripheral surfaces 32 and 40 during the application of heat. Such use of the hair clamping member 58 facilitates the forming of small or "tight" curls.

Referring next to the second variation which is best shown in FIGS. 1, 5 and 6, the annular frame 18 includes a plurality of generally spaced outwardly projecting bristles 64. The bristles 64 are generally longitudinally spaced along each of the support bars 36 and collectively form a brush 66. Use of the brush 66 in combination with the curling iron 12 facilitates the making of large "loose" curls or waves.

It should now be apparent that through the interchangeable use of the two illustrated variations of the hair grooming attachment just described, a single curling iron is operable for creating a variety of hair curls and styles.

Various of the features of the invention are set forth in the following claims.

I claim:

1. A hair curling iron comprising a handle, an elongated heating element having an outer peripheral surface and a first portion adjacent to said handle and a second portion spaced outwardly from said handle, means for defining a plurality of generally arcuately spaced grooves extending longitudinally on said outer peripheral surface of said heating element between said first portion and said second portion, and a hair grooming attachment comprising an annular frame including a plurality of arcuately spaced support bars slidingly engaged in said grooves, and a hair clamping member pivotally attached on said annular frame and movable between a first position in which said hair clamping member extends at an angle from said annular frame and a second position in which said hair clamping member is closely adjacent to said annular frame.

2. A hair curling iron according to claim 1 wherein said annular frame includes a first frame end and wherein said hair clamping member is pivotally attached on said annular frame adjacent to said first frame end.

3. A hair curling iron according to claim 1 or 2 wherein said hair clamping member fits in registry with said annular frame when said hair clamping member is in said second pivotal position.

* * * * *